US006074110A

United States Patent [19]

Verlinden et al.

[11] Patent Number: 6,074,110

[45] Date of Patent: Jun. 13, 2000

[54] SHEET MATERIAL PROCESSING APPARATUS

[75] Inventors: Bartholomeus Verlinden, Tongeren; Theo Hugal, Antwerpen, both of Belgium

[73] Assignee: Agfa-Gevaert, Mortsel, Belgium

[21] Appl. No.: 09/230,018

[22] PCT Filed: Jul. 10, 1997

[86] PCT No.: PCT/EP97/03721

§ 371 Date: Oct. 25, 1999

§ 102(e) Date: Oct. 25, 1999

[87] PCT Pub. No.: WO98/06005

PCT Pub. Date: Feb. 12, 1998

[30] Foreign Application Priority Data

Jul. 31, 1996 [EP] European Pat. Off. ..... 96202164

[51] Int. Cl.[7] ..... G03D 3/08

[52] U.S. Cl. ..... 396/612; 396/636

[58] Field of Search ..... 396/612, 636; 271/273

[56] References Cited

U.S. PATENT DOCUMENTS

| | | | |
|---|---|---|---|
| 4,632,382 | 12/1986 | Heist et al. | 271/273 |
| 5,512,972 | 4/1996 | Domen et al. | 354/319 |
| 5,606,720 | 2/1997 | Verhoest et al. | 396/620 |

*Primary Examiner*—D. Rutledge
*Attorney, Agent, or Firm*—Baker Botts L.L.P.

[57] ABSTRACT

A sheet material processing apparatus comprises at least one treatment cell in which a pair of rotatable path-defining rollers (28, 30) define a sheet material path (20) through the cell. The path-defining rollers have a closed position in which the path-defining rollers are biased into contact with each other to form a nip (36) through which the seat material path extends, and an open position in which the path-defining rollers are spaced from each other. The path-defining rollers can be separated from one another, for the purpose of cleaning the apparatus, by a simple and convenient construction in which the rollers (28, 30) are supported by bearings (70, 72) carried by eccentric sleeves (68) which are stationary in the closed position. Means (76) are provided for partly rotating the sleeves (68) thereby to withdraw the path-defining rollers (28, 30) from each other into the open position.

10 Claims, 5 Drawing Sheets

SHEET MATERIAL PROCESSING APPARATUS

FIELD OF THE INVENTION

The present invention relates to a sheet material processing apparatus, such as X-ray film, pre-sensitised plates, graphic art film and paper, and offset plates. In particular the invention relates to such an apparatus comprising at least one treatment cell, a pair of rotatable rollers biased into contact with each other to form a nip through which the sheet material path extends.

BACKGROUND OF INVENTION

As a rule, a processing apparatus for photographic sheet material comprises several treatment cells, most of all of which are in the form of vessels containing a treatment liquid, such as a developer, a fixer or a rinse liquid. As used herein, the term "sheet material" includes not only photographic material in the form of cut sheets, but also in the form of a web unwound from a roll. The sheet material to be processed is transported along a sheet material path through these vessels in turn, by transport means such as one or more pairs of path-defining drive rollers, and thereafter optionally to a drying unit. The time spent by the sheet material in each vessel is determined by the transport speed and the dimensions of the vessel in the sheet feed path direction.

The apparatus may have a horizontal configuration, where a number of treatment cells are positioned one beside the other, or a vertical configuration where a number of treatment cells are positioned one above another in the form of a stack, with the sheet material moving either in an upwards, or in a downwards direction.

Since the path-defining rollers have an elastomeric surface, if the apparatus is left with the rollers biased together, even without any processing liquid being present, the rollers may become temporarily deformed. When the apparatus is re-started, this may result in poor quality image reproduction for the first few sheets processed from the re-start, after which the deformation disappears.

During the processing of the sheet material, the rollers may become coated with debris, such as gelatine from the sheet material. If the apparatus is switched off with the rollers stationary, some disturbing crystallisation on the rollers may occur, which may reduce the quality of the processed sheets. Moreover if the apparatus is left switched off with the rollers stationary and any roller pair biased together, then the rollers may become glued together by the gelatine.

Thus, from time to time it is necessary to clean the processing apparatus, in order to remove debris which may derive from the sheet material itself and deposits derived from the treatment liquids. The usual process for cleaning a processing apparatus, whether of the vertical or horizontal configuration, is to drain the treatment liquids and to flush the apparatus through with cleaning liquid. Water, optionally containing various additives and optionally at an elevation temperature, is the usual cleaning liquid.

A sheet material processing apparatus is knows, for example from EP 93201957.3 (Agfa-Gevaert NV) in which the path-defining rollers have a closed position in which they are biased into contact with each other to form a nip through which the sheet material path extends and an open position in which the path-defining rollers are spaced from each other. At each end of at least one of the rollers, displacement means are provided to move the rollers apart. To achieve this, the roller shafts are mounted in bearings held in slidably mounted sub-frames. The construction is however somewhat complicated.

OBJECTS OF INVENTIONS

It is an object of the present invention to provide an apparatus in which the path-defining rollers can be separated from each other in the open position, in a simple and convenient manner.

SUMMARY OF THE INVENTION

We have discovered that this, and other useful objectives may be achieved where the path-defining rollers are supported by bearings carried by eccentric sleeves which are stationary in the closed position, and where means are provided for partly rotating the sleeves thereby to withdraw the path-defining rollers from each other into the open positions.

Thus, according to the invention, there is provided a sheet material processing apparatus comprising at least one treatment cell, a pair of rotatable path-defining rollers defining a sheet material path through the cell, the path-defining rollers having a closed position in which the path-defining rollers are biased into contact with each other to form a nip through which the sheet material path extends and an open position in which the path-defining rollers are spaced from each other, characterised in that the path-defining rollers are supported by bearings carried by eccentric sleeves which are stationary in the closed position, and means are provided for partly rotating the sleeves thereby to withdraw the path-defining rollers from each other into the open position.

The bearing assemblies which comprise the bearings and the eccentric sleeves may be constituted by slide bearings, but a combination of slide bearings and needles bearings, but more preferably by ball bearing assemblies. The bearings may be provided at only one end, or at each end of each path-defining roller. The shafts of the path-defining rollers may be held in ball bearing assemblies carried by end walls of the cell. Each bearing assembly may comprise an outer sleeve fixed to the cell end wall, an inner sleeve fixed to the roller shaft and an eccentric intermediate sleeve. There is thereby defined there-between an inner ball race and an outer ball race. The inner ball race allows the roller shaft to run freely in the bearing assembly, while the outer ball race allows the eccentric intermediate sleeve to turn freely in the outer sleeve.

A toothed segment may be provided as an extension of the eccentric intermediate sleeve. Since the eccentric sleeves need not make a complete revolution as the path-defining rollers are moved from the closed to the open position, indeed a rotation of from 90° to 270°, such as about 180° is suitable, the toothed segments need not be provided with gear teeth around their total periphery. In fact the provision of gear teeth over only that angle which corresponds to the required angle of rotation of the eccentric sleeve provides advantages in terms of positional stability. However, if desired, the gear teeth can be provided over the whole periphery, in which case the toothed segments constitute gear wheels.

Where the bearings are constituted by ball bearing assemblies, the centre of the toothed segment suitably lies along the axis of the outer ball race of the assembly. The toothed segments may mesh with a toothed rack which is mounted for longitudinal movement, whereby the movement thereof causes the toothed segments to rotate. In place of a toothed rack, a further gear wheel which meshes with both toothed segments may be used. However, a toothed rack is preferred, especially where the roller opening arrangement is provided in a number of cells of the apparatus, whereby a common toothed rack can be used for opening all the cells of the apparatus, either simultaneously or sequentially. The toothed rack may carry optionally adjustable stop means to limit the degree of movement of the rack in one direction, this limit position corresponding to the case where the roller shafts are at their closest position. In the closed position, the path-defining roller axes are in a fixed position to ensure a homogeneous pressure on each other.

As the toothed rack moves away from this limit position, the toothed segments are rotated in the direction opposite to the path-defining rollers' normal direction of rotation. This causes the roller shafts to be urged away from each other leading to separation of the path-defining rollers from each other. The toothed rack may carry second end stop means which act to limit the movement of the rack in the upward direction, this limit position corresponding to the open position of the path-defining rollers.

In the open position, the axes of the path-defining rollers are in a fixed positional determined by the second end stop means, to ensure that there is no contact and therefore no pressure between the path, defining rollers. In the open position of the path-defining rollers, the elastomeric covering is separated from the respective sealing rollers.

In an alternative construction, the inner bearing of the bearing assembly may be replaced by a one-way bearing so placed that the outer ring of the one-way bearing is fixed to the eccentric sleeve and the rollers are able to run free during normal transport. In this case, opening of the rollers is achieved, not by activating the toothed rack, but by reversing the direction of the driven roller. The toothed segment carried on the eccentric sleeve will then activate the toothed rack and in turn cause the opposite roller to open. The toothed rack will compress a cylindrical compression spring, which will deliver the force needed to close the rollers. During the time that the rollers are open, the spring is compressed by a force delivered by the driven roller. To protect the system from overload, a slip coupling is installed between the toothed rack and the drive.

In a further alternative construction, the toothed rack is replaced by a driven gear wheel which engages both toothed segments.

Preferably, the apparatus further comprises means for rotating the path-defining rollers in a first rotational direction i the closed position. In one embodiment of the invention, co-operating gear means are provided carried on the path-defining rollers to transfer drive from one of the path-defining rollers to the other of the path-defining rollers, the gear means co-operating with each other both in the closed and the open positions. The gear wheels may be provided with deep gear teeth, thereby ensuring that the gear wheels remain meshed with each other, even in the open position of the path-defining rollers.

The means for partly rotating the sleeves may comprise a toothed rack in engagement with teeth carried on the eccentric sleeves. Stops may be provided for limiting the movement of the toothed rack.

Typical path-defining rollers have a core provided with a covering of elastomeric material, although it is possible for the roller to be elastomeric throughout its cross-section.

As the sheet material leaves a given liquid treatment cell it is necessary to remove any liquid carried on the sheet material as efficiently as possible, to reduce edge effects which arise from non-homogeneous chemistry on the sheet material after squeegeeing. To do this job properly, the path-defining rollers much exert a sufficient and homogeneous pressure over the whole width of the sheet material. Also, to reduce edge effects, it is desirable that the opposite path-defining roller surfaces are in contact with each other beyond the edges of the sheet material. To put this problem in context, path-defining rollers used in conventional processing apparatus for example having a length of 400 mm to 2000 mm or more and a diameter of from 20 to 60 mm. The sheet material typically has a width of from a few millimeters up to 2 m and a thickness of 0.05 mm to 0.5 mm. In view of the nature of elastomeric material, it is in fact impossible to totally eliminate any gap between the path-defining roller surfaces at the edges of the sheet material as it passes through the nip. It is desirable that the path-defining roller surfaces be in contact with each other within a short a distance as possible from the edges of the sheet material i.e. that the size of the leak zone should be minimised. It is important however that the force between the path-defining rollers is sufficient to prevent leakage when no sheet material is passing through. However, the force must not be so high as to risk physical damage to the sheet material as it passes through the nip.

The objective of a minimum leak zone referred to above can be achieved if the ratio of the diameter of the path-defining roller to its length is above a critical limit.

To enable this objective to be achieved, the ratio of the diameter of the path-defining roller to tis length should be above a critical limit. In particular, at least one of the path-defining rollers, and preferably each path-defining roller, comprises a rigid core carrying a covering of elastomeric material, the ratio ($\phi$/L) of the maximum diameter ($\phi$) of the elastomeric material covering to the length (L) thereof being at least 0.012, most preferably between 0.03 and 0.06. Preferably both path-defining rollers conform to this requirement, although it is possible that the diameters ($\phi$), and therefore the ratios ($\phi$/L), of the two path-defining rollers need not be identical.

The elastomeric material covering preferably has a thickness of between 1 mm and 30 mm. The elastomeric material may be selected from ethylene/propylene/diene terpolymers (EPDM), silicone rubber, polyurethane, thermoplastic rubber such as SANTOPRENE (Trade Mark for polypropylene/EPDM rubber), styrene-butyl rubber, nitrile-butyl rubber, PFA and Fluor-Latex (FLC) material. The hardness of the elastomeric material may be between 15 Shore (A) and 90 Shore (A), as measured on the roller surface. Where the elastomeric material comprises an inner layer of relatively low hardness and an outer layer of relatively high hardness, the inner layer should have a hardness of less than 50 Shore A, while the outer layer should have a hardness of more than 25 Shore A.

In one embodiment of the invention, the diameter ($\phi$) of the elastomeric material covering is constant along the length of the path-defining roller. Alternatively the path-defining roller may have a radial dimension profile which varies along the length thereof. In the latter case, the diameter ($\phi$) in the expression $\phi$/L is the maximum diameter. Alternatively or additionally, the diameter of the core varies along the length thereof. Ideally, the radial dimension profile of such a path-defining roller is such in relation to the force applied by the path-defining roller to sheet material passing through the nip as to be substantially even over the width thereof.

Preferably, the core has a flexural E-modulus of between 50 GPa and 300 GPa. Suitable material for the rigid core include metals, such as stainless steel, non-ferrous alloys, titanium, aluminium or a composite thereof.

In one embodiment of the invention, the core is hollow. Alternatively the core may be solid.

The path-defining rollers may be biased together by a variety of methods. The rollers may be biased together for example by making use of the intrinsic elasticity of the elastomeric material, by the use of fixed roller bearings. Alternatively, use may be made of resilient means such as springs which act on the ends of the roller shafts. The springs may be replaced by alternative equivalent compression means, such as e.g. a pneumatic or a hydraulic cylinder.

Each path-defining roller may be associated with sealing means which provides a seal between the surface of the roller and the housing of the associated cell. When the rollers are moved apart, the roller surface may maintain contact with the sealing means, depending upon the construction of the latter, or may separate therefrom.

Thus, in the closed position, the path-defining roller may be in sealing contact along its length, with a rotatable sealing member. By the use of a rotatable sealing member in place of a stationary sealing member, the torque which needs to be applied to the path-defining roller can be significantly reduced. This reduces the power needed by the processor, reduces wear on the path-defining roller, reduces the mechanical deformation thereof and thereby extends the expected lift time. This construction also improves the control of pressure distribution over the sheet material.

The rotatable sealing member preferably comprises a sealing roller, and in particular the sealing roller may have a diameter less than that of the path-defining roller. For example, the sealing roller may have a diameter which is from one tenth to one their of the diameter of the path-defining roller, thereby enabling the torque which needs to be applied to be further reduced. The sealing roller preferably extends in a straight line parallel to the associated path-defining roller axis and preferably contact the surface of the associated path-defining roller at a location which is between 45° and 315°, most preferably between 80° and 100° from the center of the nip, on the fluid side.

The sealing roller may be formed of a material having a coefficient of friction (as measured against stainless steel) of less than 0.3, preferably from 0.05 to 0.2, for example highly polished metals such as steel, especially Cr-Ni steel and Cr-Ni-Mo steel, a metal coated with Ni-PTFE (NIFLOR - Trade Mark), a polymer material such as PTFE (poly tetra fluoro ethylene), POM (polyoxymethylene), HDPE (high density polyethylene), UHMPE (ultra high molecular weight polyethylene), polyurethane, PA (polyamide), PBT (polybutyl terephthalate) and mixtures and composites thereof.

In a preferred embodiment, the sealing roller is carried by a longitudinal bearing, secured within the vessel. The surface of the sealing roller opposite to the path-defining roller may be in contact with one or more fixed sealing members carried in, or formed as part of, the longitudinal bearing. The fixed sealing member may, for example, be retained within a longitudinal groove formed in the longitudinal bearing.

In addition to the path-defining rollers and associated sealing means, one or more of the cells of the apparatus may include additional features if desired. In additional to the rollers and associated sealing means, one or more of the cells of the apparatus may include additional features if desired. Cleaning means such as cleaning rollers or cleaning brushes may be provided for acting upon the rollers to assist the removal of debris therefrom, as described in European patent application EP 93202862 (Agfa-Gevaert NV), filed Oct. 11, 1993. Additional rollers, such as a roller pair or staggered rollers may be provided for transporting the sheet material through the apparatus, and these rollers will normally be driven rollers. Additional roller pairs may be provided for breaking the laminar fluid at the surface of the sheet material as it passes through the apparatus, and these rollers may be driven rollers or freely rotating rollers. Spray means may be provided for applying treatment liquid to the sheet material. Guide means may be included for guiding the passage of the sheet material through the apparatus.

Heating means may be provided in one or more cells so that the cell becomes a sheet material drying unit, rather than a wet treatment unit. While liquid pumping, heating, cooling and filtering facilities will normally be provided outside the cells, it is possible for some elements of these features to be included in the cells themselves. Any combination of these additional features is also possible.

The apparatus according to the invention may be cleaned by the steps of:(i) draining treatment liquid from the cells; (ii) feeding a cleaning liquid to a first cell; (iii) allowing at least a portion of the cleaning liquid to pass from the first cell to at least one further cell: and (iv) discharging the cleaning liquid from the apparatus.

In one embodiment, the first cell is a developing cell and the further cell, i.e. the next cell to be cleaned, is a fixing cell. A cell adapted for the rinsing of the photographic sheet material may follow.

Preferably, where the apparatus has a vertical configuration, all the cleaning liquid in the first cell is allowed to pass by gravity to the next cell to be cleaned. However, where the cells are of different liquid capacity, it is possible that only part of the cleaning liquid is passed from the first cell to the next cell to be cleaned, the remaining cleaning liquid being discharged or, better, fed to another cell to be cleaned.

The cleaning liquid may comprise water and will usually consist of substantially pure water, although water-miscible organic solvents such as lower alcohols, and surface active agents, may also be present in the cleaning liquid.

The cleaning process may be carried out manually or automatically

It will be usual that most, if not all, of the cells in the apparatus are in the form of vessels, suitable for containing treatment liquid, the rollers and sealing means serving to retain treatment liquid in the vessel. Other cells may not contain processing liquid, these cells proving, for example, a dead space where diffusion reactions can occur on the sheet material as it passes there-through. In an apparatus with a vertical configuration, the top-most cell may, however, not be a liquid-containing vessel, serving simply as the gas-tight cover for the apparatus.

BRIEF DESCRIPTION OF THE DRAWING

The invention will be described by the following illustrative embodiments with reference to the accompany drawings without the intention to limit the invention thereto, and in which.

DETAILED DESCRIPTION OF THE INVENTION

Although only one specific embodiment of a treatment vessel according to the invention is shown in the Figures, the invention is not restricted thereto. The apparatus for the wet processing of photographic sheet material such as X-ray film, graphic are film and paper, pre-sensitised plates and offset plates, as shown in the figures, comprises a plurality of treatment vessels mounted one above another. These vessels may be arranged to provide a sequence of steps in the processing of sheet photographic material, such as developing, fixing and rinsing. The vessels may be of a modular structure as shown or may be part of an integral apparatus.

Figure 1:
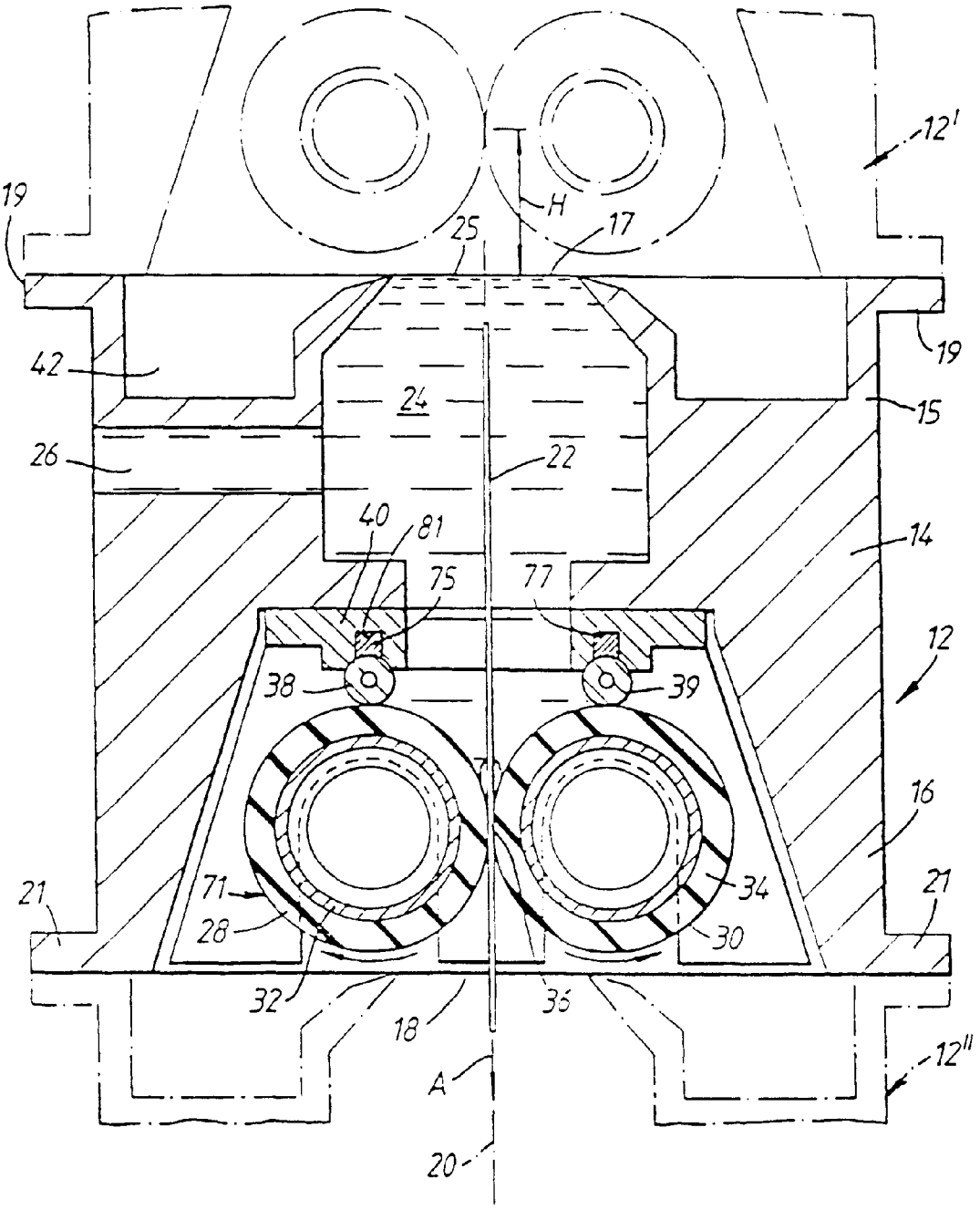
FIG. 1 is, in solid lines, a cross-sectional view of one vessel of a vertical processing apparatus according to the to the invention, with adjacent vessels being partly shown in broken lines.
Figure 2:
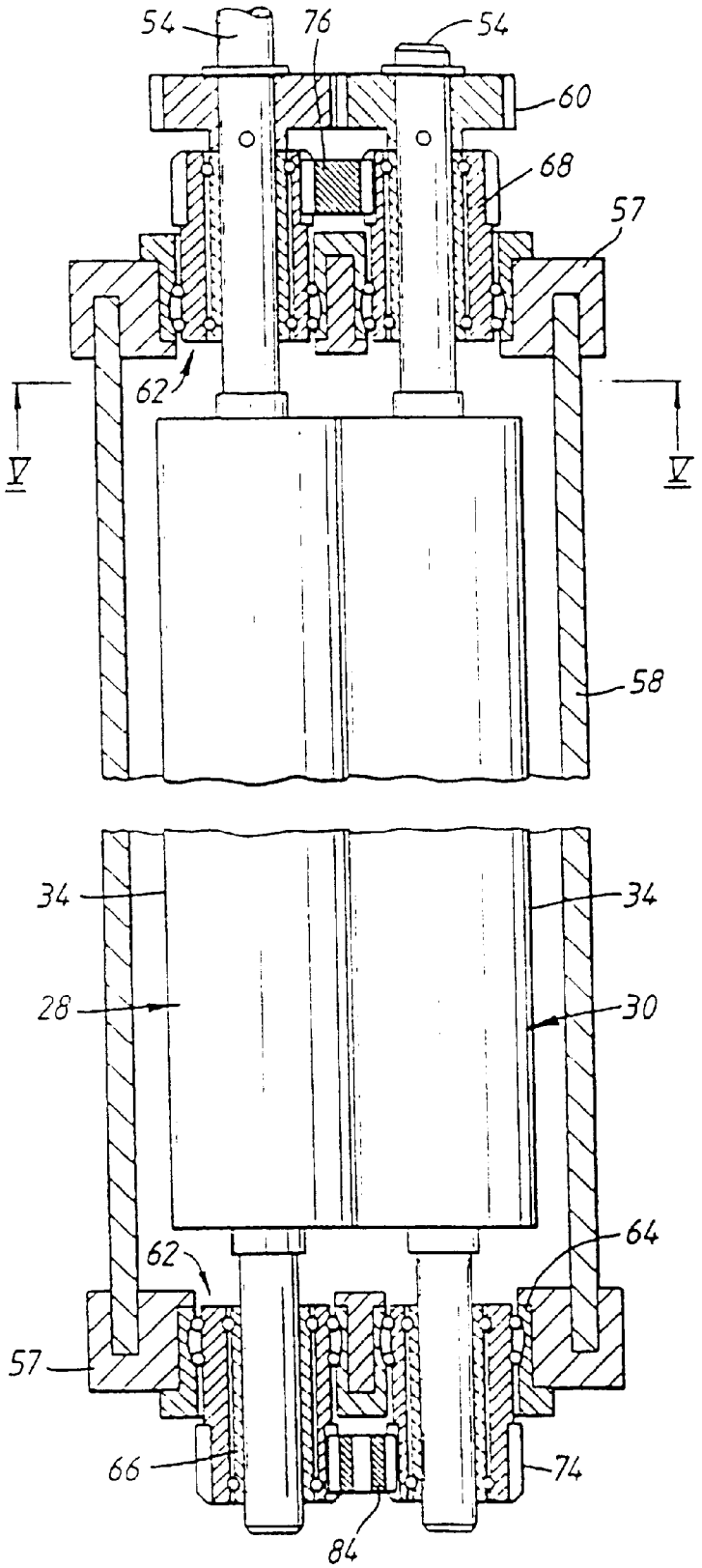
FIG. 2 is a top view of one cell of the apparatus shown in FIG. 1, with the rollers closed.
Figure 3:
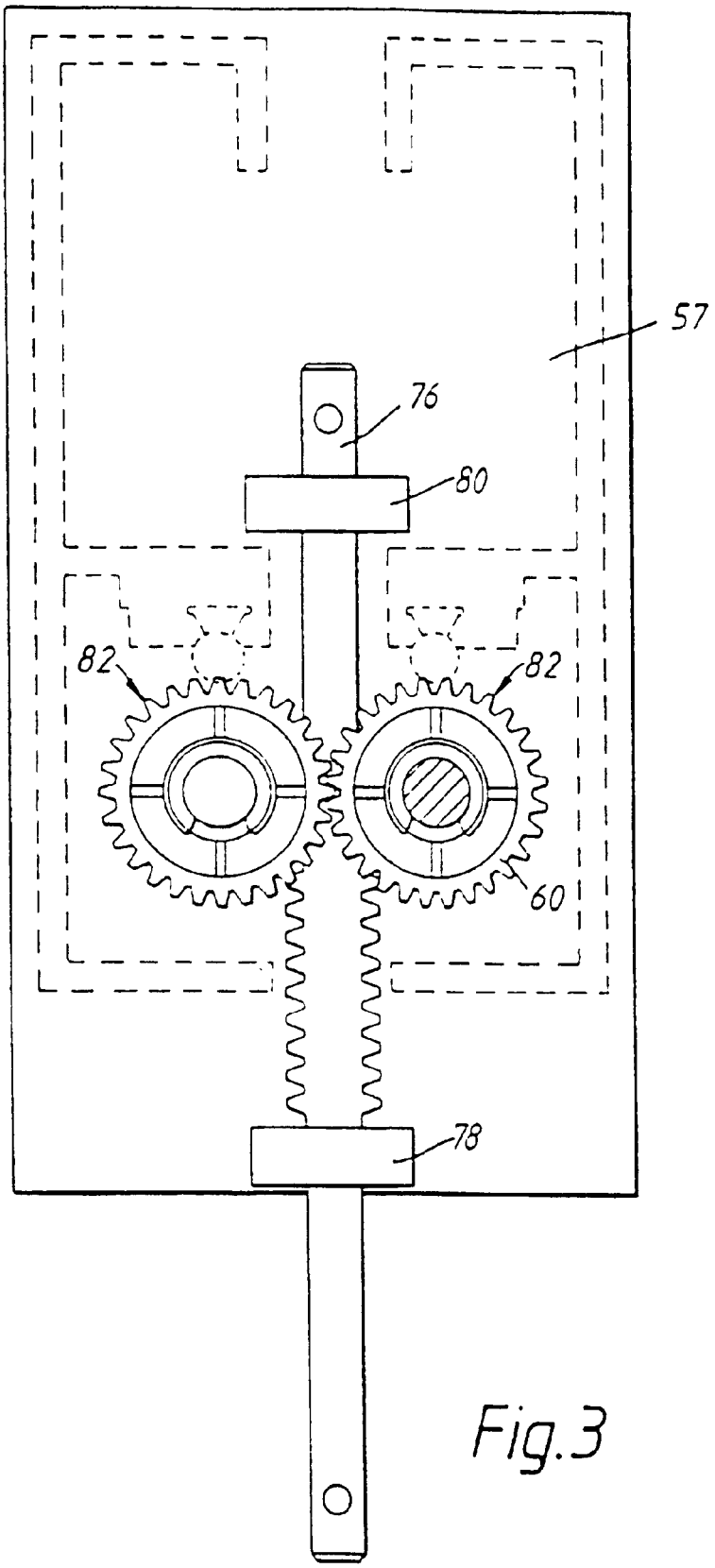
FIG. 3 is a rear view of the cell, with the rollers closed.
Figure 4:
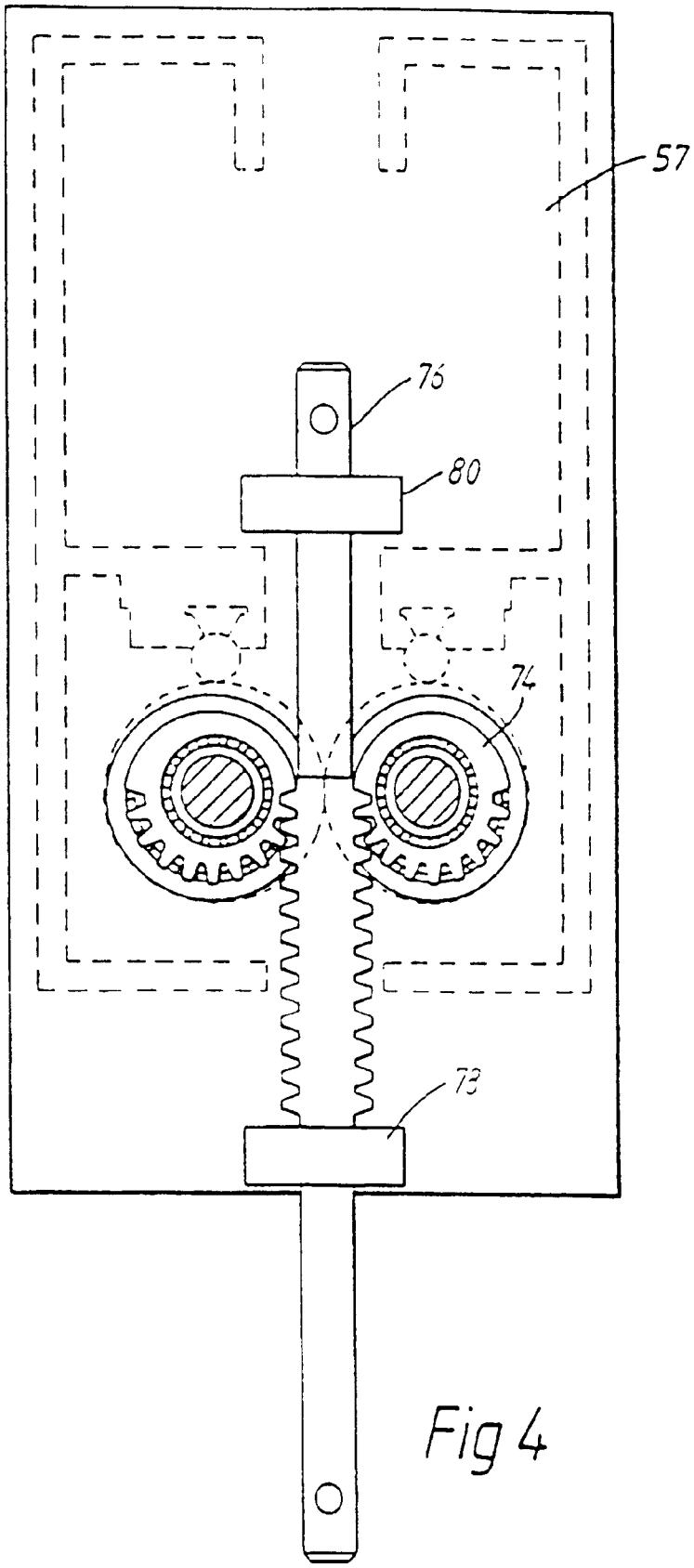
FIG. 4 is a front view of the cell with the rollers closed.
Figure 5:
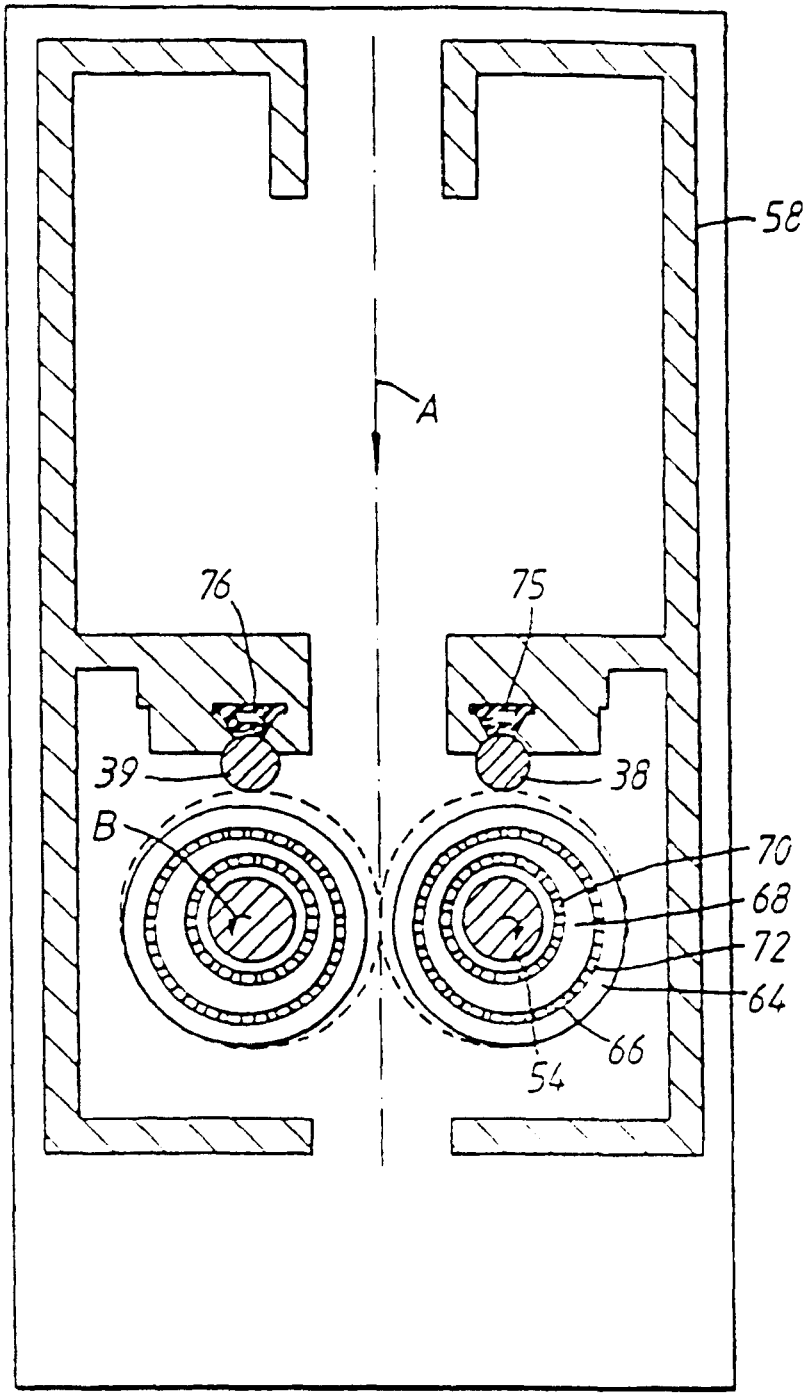
FIG. 5 is a section taken on the line V—V in FIG. 2, with the rollers closed.

As shown in FIG. 1, each vessel 12 comprises a housing 14 which is of generally rectangular cross-section and is so shaped as to provide an upper part 15 having an upper opening 17 and a lower part 16 having a lower opening 18. The upper opening 17 constitutes a sheet material inlet and the lower opening 18 constitutes a sheet material outlet. The inlet and outlet define there-between a substantially vertical sheet material path 20 through the vessel 12, the sheet material 22 moving in a downwards direction as indicated by the arrow A. Each vessel 12 may contain treatment liquid 24, a passage 26 in the housing 14 being provided as an inlet for the treatment liquid 24.

The lower opening 18 is closed by a pair of rotatable path-defining rollers 28, 30 carried in the apparatus. Each path-defining roller 28, 30 is of the squeegee type comprising a stainless steel hollow core 32 carrying an elastomeric covering 34. The core 32 is in cylindrical form having constant internal and external diameters along the length thereof. The path-defining rollers 28, 30 are of identical length biased towards each other with a force sufficient to effect a liquid tight seal but without causing damage to the photographic sheet material 22 as it passes there-between. The line of contact between the path-defining rollers 28, 30 defines a nip 36. The nip 36 has a length which extends beyond the limits of the lower opening 18. The sheet material preferably has a width which is at least 10 mm smaller than the length of the nip 36, so as to enable a spacing of at least 5 mm between the edges of the sheet and the adjacent limit of the nip, thereby to minimise leakage.

Each path-defining rollers 28, 30 is in sealing contact along its length, with a respective rotatable sealing roller 38, 39 formed for example of hardened or PTFE-coated metal carried by a longitudinal bearing 40, formed, for example, of high density polyethylene. The longitudinal bearing 40 is secured to the housing 14 of the vessel 12, the treatment liquid 24 being retained in the vessel 12 by the path-defining rollers 28, 30 and the sealing rollers 38, 39. The sealing roller 38 contacts the surface 71 of the first path-defining roller 28 at a location which, in this particular embodiment, is about 90° from the center of the nip 36 on the fluid side, that is from the plane joining the axes of rotation of the path-defining rollers 28, 30. The benefit of this arrangement is that the sealing force on the path-defining roller does not influence the bias forces between the rollers, or only influence these forces to a limited extent.

The upper and lower housing parts 15, 16 are provided with flanges 19, 21 respectively to enable the vessel 12 to be mounted directly above or below an identical or similar other vessel 12', 12", as partly indicated in broken lines in FIG. 1. The upper housing part 15 is so shaped in relation to the lower housing part 16 as to provide a substantially closed connection between adjacent vessels. Thus, treatment liquid from vessel 12 is prevented from falling into the lower vessel 12" by the path-defining rollers 28, 30 and sealing rollers 38, 39, while vapours from the lower vessel 12" are prevented from entering the vessel 12 or escaping into the environment. This construction has the advantage that the treatment liquid in one vessel 12 is not contaminated by contents of the adjacent vessels and that by virtue of the treatment liquids being in a closed system evaporation, oxidation and carbonisation thereof is significantly reduced.

The upper part 15 of the housing 14 is so shaped as to define a leakage tray 42. Any treatment liquid which may pass through the roller nip of the next higher vessel 12', in particular as the sheet material 22 passes therethrough, drips from the path-defining rollers of the vessel and falls into the leakage tray 42 from where it may be recovered and recirculated as desired. The distance H between the surface 25 of the liquid 24 and the nip of the path-defining rollers of the next upper vessel 12' is as low as possible. The rollers 28 comprises a hollow core 32 of stainless steel, having a constant outside diameter of 25 mm and an internal diameter of 19 mm. The stainless steel core 32 has a flexural E-modulus of 210 GPa. The core 32 is provided with a covering 24 of EPDM rubber, an elastomer having hardness of 30 Shore (A). The elastomeric covering 34 has a thickness varying from 7 mm and the roller ends to 7.5 mm at the roller center. The path-defining roller 28 has a length of 750 mm and a maximum diameter of 40 mm. The maximum $\phi/L$ ratio is therefore approximately 0.053. The core 32 is welded at each end of to the boss 46 of a roller shaft 54 which extends axially out of the roller. The construction of path-defining roller 30 is similar.

The path-defining roller 28 is in contact with the sealing roller 38 along the length thereof. The upper surface of the sealing roller 38 is in contact with a fixed sealing member 75 in strip form, which is a pressure fit in the groove 81 of the longitudinal bearing 40 or alternatively is secured therein by means of a water- and chemical-proof adhesive, and extends lengthwise beyond the ends of the sealing roller 38.

The sealing member 75 is, for example, an extruded profile of SANTOPRENE, an extrusion of various different grades of SANTOPRENE or an extrusion of SANTOPRENE with polypropylene. In all these cases, the SANTOPRENE may be foamed or un-foamed. The SANTOPRENE may be replaced by EPDM. The polypropylene maybe replaced polybutyl terephthalate (PBT). A sealing member which is a co-extrusion of EPDM with PBT is also possible. Fillers may be included in the sealing material. The sealing member should have good chemical resistance durability.

As can be seen in FIG. 1, a similar sealing member 77 is in contact with the second sealing roller 39.

FIGS. 2 to 5 show one cell of the processing apparatus, comprising cell end walls 57 and cell body walls 58 and containing the pair of rotatable path-defining rollers constituted by a drive roller 28 and a driven roller 30. The shafts 54 of the path-defining rollers 28, 30 extend through the cell end walls 57. At one end of the cell, the roller shafts carry on their free ends intermeshing gear wheels 60 which ensure that both path-defining rollers are driven simultaneously, in such a direction as to drive sheet material along the sheet material path in the direction of the arrow A.

The shafts 54 of the path-defining rollers 28, 30 are held in ball bearing assemblies 62 carried by the cell end walls 57. Each bearing assembly 62 comprises an outer sleeve 64 fixed to the cell end wall 57, an inner sleeve 66 fixed to the roller shaft 54 and an eccentric intermediate sleeve 68, thereby defining there-between an inner ball race 70 and an outer ball race 72. The inner ball race 70 allows the roller shaft to run freely in the bearing assembly 62. The outer ball race 72 allows the eccentric intermediate sleeve 68 to turn freely in the outer sleeve 64. The outer sleeve 64 has a concave curved ball engaging surface to ensure self-alignment. In place of the separate outer sleeve 64, a ball engaging surface may be formed directly on the cell end wall 57.

A toothed segment 74, having gear teeth provided over an angle of approximately 180° thereof, constitutes an extension of the eccentric intermediate sleeve 68, the center of the toothed segment 74 lying along the axis of the outer ball race 72. At one end of the cell, the pair of toothed segments 74 mesh with a toothed rack 76 which is mounted for longitudinal movement, whereby the movement thereof causes the toothed segments 74 to rotate. The toothed rack 76 carrier a stop 78 which acts upon a fixed top (not shown) carried on the frame of the apparatus to limit the degree of movement of the rack in one direction, this limit position corresponding to the case where the roller shafts are at their closes position. In the closed position of the path-defining rollers 28, 30, the surface of the elastomeric covering 34 is in contact with the associated rotatable sealing roller 38, 39 which in turn is in contact with the stationary sealing member 75, carried in the cell body wall 58. In the closed position, the path-defining roller axes are in a fixed position to ensure a homogeneous pressure on each other and a homogeneous pressure on the sealing rollers 38, 39. At the other end of the cell, the pair of toothed segments 74 mesh with a further toothed rack 84.

As the toothed rack 76 moves away from this limit position (upwardly in FIG. 4), the toothed segments 74 are rotated by approximately 180° in the direction opposite to the path-defining rollers' normal direction of rotation. This causes the roller shafts 54 to be urged away from each other in the direction indicated by the arrows B leading to separation of the path-defining rollers 28, 30 from each other. The toothed rack 76 carries a second end stop 80 wchih acts upon a second fixed stop (not shown) carried on the frame of the apparatus to limit the movement of the rack 76 in the upward direction, this limit position corresponding to the open position of the path-defining rollers 28, 30.

In the open position, the axes of the path-defining rollers 28, 30 are in a fixed position determined by the second end stop 80, to ensure that there is not contact and therefore no pressure between the path-defining rollers 28, 30 and that there is not contact between the path-defining rollers 28, 20 and the sealing rollers 38, 39. In the open position of the path-defining rollers 28, 30, the elastomeric covering 34 is separated from the respective sealing rollers 38, 39.

Returning to the gear wheels 60, it should be noted that these are provided with deep gear teeth 82, thereby ensuring that the gear wheels remain meshed with each other, even in the open position of the path-defining rollers 28, 30.

Reference Number List

| | |
|---|---|
| vessel 12 | gear wheels 60 |
| other vessel 12', 12" | bearing assemblies 62 |

-continued

Reference Number List

| | |
|---|---|
| housing 14 | outer sleeve 64 |
| upper part 15 | inner sleeve 66 |
| lower part 16 | eccentric inter. sleeve 68 |
| upper opening 17 | inner ball race 70 |
| lower opening 18 | outer ball race 72 |
| flanges 19, 21 | toothed segment 74 |
| path 20 | sealing member 75 |
| sheet material 22 | sealing member 77 |
| treatment liquid 24 | rack 76 |
| surface 25 | 1st end stop 78 |
| passage 26 | 2nd end stop 80 |
| path-defining rollers 28, 30 | groove 81 |
| core 32 | gear teeth 82 |
| covering 34 | toothed rack 84 |
| nip 36 | |
| sealing roller 38, 39 | |
| longitudinal bearing 40 | |
| surface 71 | |
| leakage tray 42 | |
| distance H | |
| boss 46 | |
| roller shaft 54 | |
| end walls 57 | |
| body walls 58 | |

What is claimed is:

1. A sheet material processing apparatus comprising at least one treatment cell, a pair of rotatable path-defining rollers (28, 30) defining a sheet material path (20) through said cell, said path-defining rollers have a closed position in which said path-defining rollers are biased into contact with each other to form a nip (36) through which said sheet material path extends and an open position in which said path-defining rollers are spaced from each other, characterized in that said path-defining rollers (28, 30) are supported by bearings (70, 72) carried by eccentric sleeves (68) which are stationary in said closed position, and means (76) are provided for partly rotating said sleeves (68) thereby to withdraw said path-defining rollers (28, 30) from each other into said open position.

2. An apparatus according to claim 1, wherein said bearings are comprised by a ball bearing assembly (62).

3. An apparatus according to claim 2, wherein each said bearing assembly (62) comprises an outer sleeve (64) fixed to a cell end wall (57), an inner sleeve (66) fixed to a shaft of said roller, and an eccentric intermediate sleeve (68).

4. An apparatus according to claim 3, wherein a toothed segment (74) is provided as an extension of said eccentric intermediate sleeve (68).

5. An apparatus according to claim 4, wherein said means for partly rotating said sleeves comprises a toothed rack (76) in engagement with said toothed segment (74).

6. An apparatus according to claim 5, further comprising stops (78, 80) limited the movement of said toothed rack.

7. An apparatus according to claim 1, further comprising means for rotating said path-defining rollers (28, 30) in a first rotational direction in said closed position and wherein said means (76) for partially rotating said eccentric sleeves (68) operate in an opposite rotational direction.

8. An apparatus according to claim 1, further comprising co-operating gear means (60) carried on said path-defining rollers (28, 30) to transfer drive from one of said path-defining rollers to the other of said path-defining rollers, said gear means (60) co-operating with each other both in said closed and said open positions.

9. An apparatus according to claim 1, wherein said bearings (70, 72) are provided at each end of each said path-defining rollers (28, 30).

10. An apparatus according to claim 1, further comprising sealing means (38, 39) associated with each said path-defining rollers (28, 30), said path-defining rollers being in contact with said sealing means in said closed position and being spaced from said sealing means in said open position.

* * * * *

UNITED STATES PATENT AND TRADEMARK OFFICE

CERTIFICATE OF CORRECTION

PATENT NO. : 6,074,110

DATED : June 13, 2000

INVENTOR(S) : Verlinden et al.

It is certified that error appears in the above-identified patent and that said Letters Patent is hereby corrected as shown below:

Column 1, line 57: "elevation" should read -- elevated --;

Column 1, line 60: "knows," should read -- known, --;

Column 2, line 34: "but" should read -- by --; and "needles" should read -- needle --;

Column 3, line 23: "positional" should read -- position --;

Column 3, line 25: "path, defining" should read -- path-defining --;

Column 3, line 48: "i" should read -- in --;

Column 4, line 28: "tis" should read -- its --;

Column 5, line 27: "lift" should read -- life --;

Column 5, line 33: "their" should read -- third --;

Column 5, line 37: "contact" should read -- contacts --;

Column 7, line 12: "are" should read -- art --;

Column 7, line 49: "rollers" should read -- roller --;

UNITED STATES PATENT AND TRADEMARK OFFICE

CERTIFICATE OF CORRECTION

PATENT NO. : 6,074,110

DATED : June 13, 2000

INVENTOR(S) : Verlinden et al.

It is certified that error appears in the above-identified patent and that said Letters Patent is hereby corrected as shown below:

Column 9, line 22: "carrier" should read -- carries --;

Column 9, line 23: "top" should read -- stop --;

Column 9, line 26: "closes" should read -- closest --;

Column 9, line 43: "wchih" should read -- which --;

Column 9, line 50: "not" should read -- no --;

Column 9, line 52: "not" should read -- no --;

Column 10, line 53: "limited" should read -- limiting --.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*